US005570912A

United States Patent [19]

Mullich

[11] Patent Number: 5,570,912

[45] Date of Patent: Nov. 5, 1996

[54] LATCH WITH ADJUSTABLE BACKSET

[75] Inventor: Richard O. Mullich, Burbank, Calif.

[73] Assignee: Emhart Inc., Newark, Del.

[21] Appl. No.: 402,668

[22] Filed: Mar. 13, 1995

[51] Int. Cl.[6] ..... E05C 1/00

[52] U.S. Cl. ..... 292/1.5; 292/337

[58] Field of Search ..... 292/1.5, 337, DIG. 60

[56] References Cited

U.S. PATENT DOCUMENTS

| | | | |
|---|---|---|---|
| 3,112,944 | 12/1963 | Adler | 292/1.5 X |
| 4,427,224 | 1/1984 | Bergen | 292/1.5 |
| 4,564,229 | 1/1986 | Mullich et al. | 292/1.5 |
| 4,623,174 | 11/1986 | Trull et al. | 292/1.5 |
| 4,746,154 | 5/1988 | Fang | 292/337 |
| 4,750,766 | 6/1988 | Shen | 292/1.5 X |
| 4,850,626 | 7/1989 | Gallego | 292/337 |
| 5,149,151 | 9/1992 | Shen | 292/1.5 |
| 5,257,837 | 11/1993 | Bishop | 292/1.5 |
| 5,354,109 | 10/1994 | Lin | 292/1.5 |

*Primary Examiner*—Rodney M. Lindsey

*Attorney, Agent, or Firm*—Spencer T. Smith

[57] ABSTRACT

An adjustable latch assembly which is to be operated by an operator assembly having a rotatable spindle including a half round actuator and a pair of connection stems which are to be inserted into the adjustable latch assembly, comprising a cover including a central opening for receiving the half round actuator, having a pair of stop surfaces for limiting clockwise or counterclockwise rotation of the half round actuator and a stem receiving hole in the end portion remote from the stop surfaces, a housing for supporting the cover for displacement from one backset location to a second backset location, a first stem hole aligned with the cover hole when the cover is at one backset location, a second stem hole, and a third stem hole rearwardly spaced from the second stem hole a distance corresponding to the backset difference, a latch-bolt head, a retracting assembly operable to displace the latch-bolt head including a displaceable retracting member having rearwardly extending legs for engaging the half round actuator when the cover is at one backset location, and a backset converter having rearwardly extending legs and an effective length equal to the backset difference.

4 Claims, 5 Drawing Sheets

LATCH WITH ADJUSTABLE BACKSET

The latch mechanism of a deadlatch may conventionally have either a 2⅜" or a 2¾" backset measurement. To avoid the need to have inventories of latches having both backset measurements, latches have been developed which can satisfy either backset requirement. A prior art latch which has an adjustable backset is disclosed in U.S. Pat. No. 4,664,433.

It is an object of the present invention to provide a low cost latch with a backset which can have either a 2⅜" or a 2¾" backset.

Other objects and advantages of the present invention will become apparent from the following portion of this specification and from the accompanying drawings which illustrate in accordance with the mandate of the patent statutes a presently preferred embodiment incorporating the principles of the invention.

Referring to the drawings.

Figure 1:
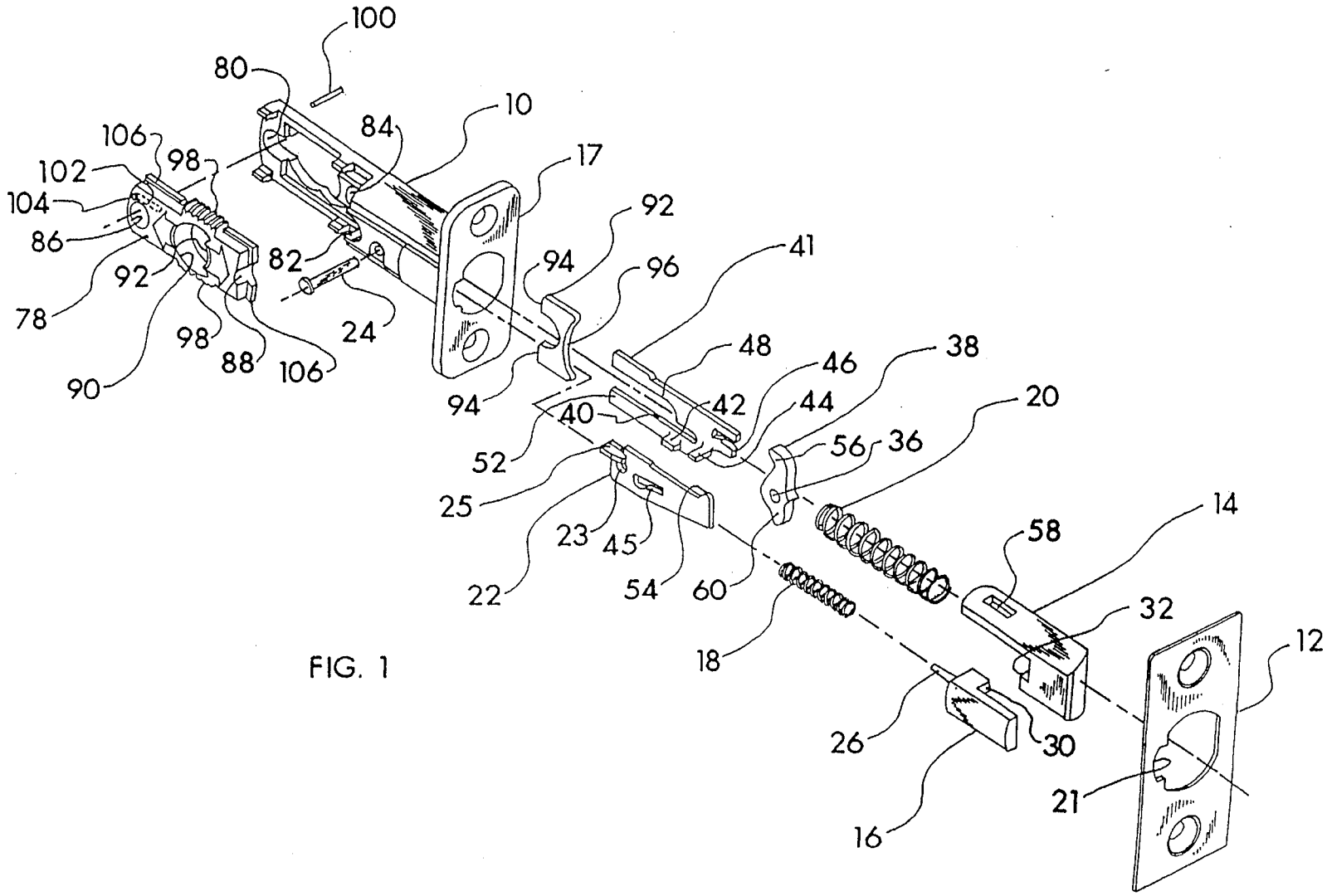
FIG. 1 is an oblique exploded view of the components of the adjustable latch made in accordance with the teachings of the present invention.

The components of the adjustable latch are shown in FIG. 1. The latch-bolt case 10 is suitably secured within a bore in a door and is dressed with a front face plate 12. A latch-bolt head 14 and a deadlatch bolt 16 are biased outwardly by associated first 18 and second 20 springs. When a door is closed the latch-bolt head 14 extends beyond the front face plate 12 and through a hole in the strike plate (not shown) and into a hole in the door jam (not shown) and the deadlatch bolt 16 (which can move relative to the latch-bolt head 14) extends beyond the face plate into a final position against the strike plate.

The adjustable latch also has a latch dog 22 which has a hole 23 for receiving a rivet 24 which is supported by the latch-bolt case. The latch dog 22 accordingly is pivotal about the rivet. The first spring 18 is compressively located on axially projecting pins 25, 26 on the latch dog and deadlatch bolt. The compressed first spring accordingly pushes the deadlatch bolt 16 forwardly until either the front of it strikes the strike plate or an inwardly projecting stop portion 30 abuts against a stop surface 32 on the latch-bolt head. The rivet also extends through a hole 36 in a latch cam 38 and through an axial slot 40 in the retracting member 41. Projecting sidewardly from the retracting member are a cam actuator 42 which engages the bottom of the latch cam 38 and a deadlock release finger 44 which is received by a deadlock release slot 45 in the latch dog 22. The top axially extending runner 48 of the retracting member slides within a suitable slot in the latch-bolt head. The second spring is compressively located between a spring receiving post 46 on the retracting member and a circular hole in the latch-bolt head and urges the retracting member rearwardly to its neutral position against the rivet.

In the fully extended position (FIG. 2) (the door is open) for the 2⅜" backset, the opposing sides of the half round spindle 50 of a latch driving spindle (not shown) engage the rear ends of the upper runner 48 and a lower leg 52 of the retracting member which is at its furthest inward position. With the retracting member at this position, the release finger 44 is at the rearward end of the release finger slot 45 and the latch dog 22 is pivoted to a position where its upwardly projecting end portion 54 engages the bottom surface 55 of the stop portion 30 of the deadlatch bolt 16. The upper end 56 of the latch cam 38 is received by a latch cam slot 58 in the latch-bolt head and the second spring 20 pushes the latch-bolt outwardly until the latch cam is rotated clockwise to the orientation where the upper end 56 engages the rear end of the latch cam slot 58 and the lower end 60 of the latch cam engages the cam actuator 42. The deadlatch bolt is pushed forward by spring 18 until it engages and is stopped by the latch-bolt head.

Figure 3:
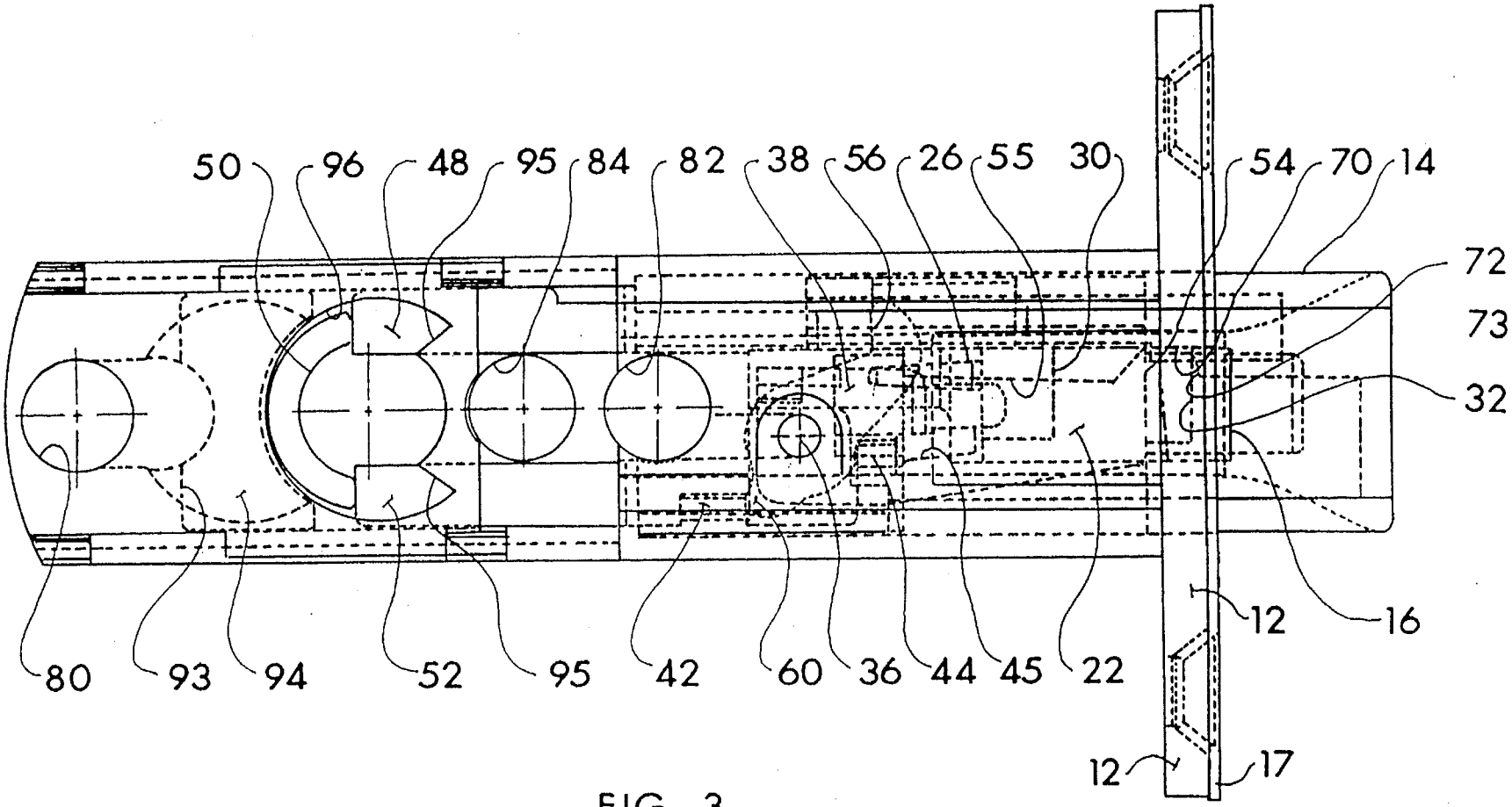
FIG. 3 is a view similar to that of FIG. 2 showing a portion of the latch assembly in the deadlocked position.

When the door is closed, the latch-bolt enters a hole in the door jam and the deadlatch bolt engages the strike plate. FIG. 3 illustrates the adjustable latch at this deadlocked position. When the deadlatch bolt engages the strike plate, its forward movement stops. It is accordingly axially shifted relative to the latch-bolt head (and the latch dog) so that the end stop portion 54 of the latch dog clears the bottom surface 55 of the stop portion 30 so that the first spring 18 can rotate the latch dog counterclockwise into a slot 70 in the latch-bolt head. The forward end of this slot is defined by a stop surface 72 on stop 73. In the event someone tries to move the latch-bolt head rearwardly, this stop surface 72 will hit the upwardly extending stop portion 54 of the latch dog to prevent further displacement.

Figure 4:
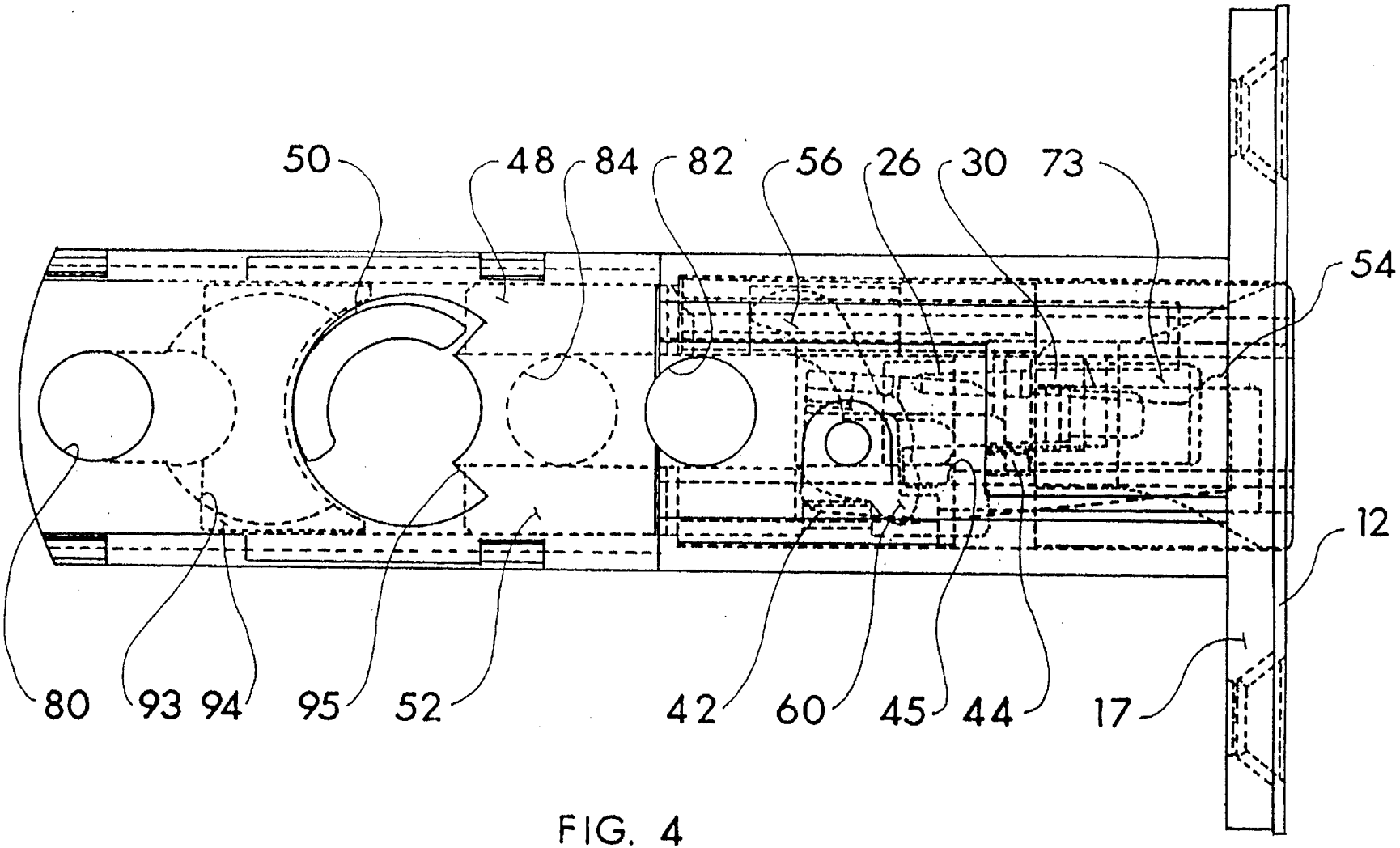
FIG. 4 is a view similar to that of FIG. 2 showing the latch assembly in the open position.

When the door is opened, the spindle is rotated to rotate the half round 50 to one of its two fully opened positions shown in FIG. 4. Movement of the retracting member forwardly results in the deadlock release finger 44 engaging the inclined ramp portion 75 of the bottom surface of the release finger slot 45 thereby pivoting the latch dog clockwise to retract the stop portion 54 of the latch dog out of the way of the stop surface 72 and to its lowest position below the stop 73. Simultaneously, the cam actuator 42 will engage and rotate the latch cam counterclockwise so that the upper end 56 of the latch cam 38 will engage the rear end of the latch-bolt head slot 58 to retract the latch-bolt head. The latch-bolt head 14 and the deadlatch bolt will be then located as shown in FIG. 4 at the bolt retracted position.

Figure 2:
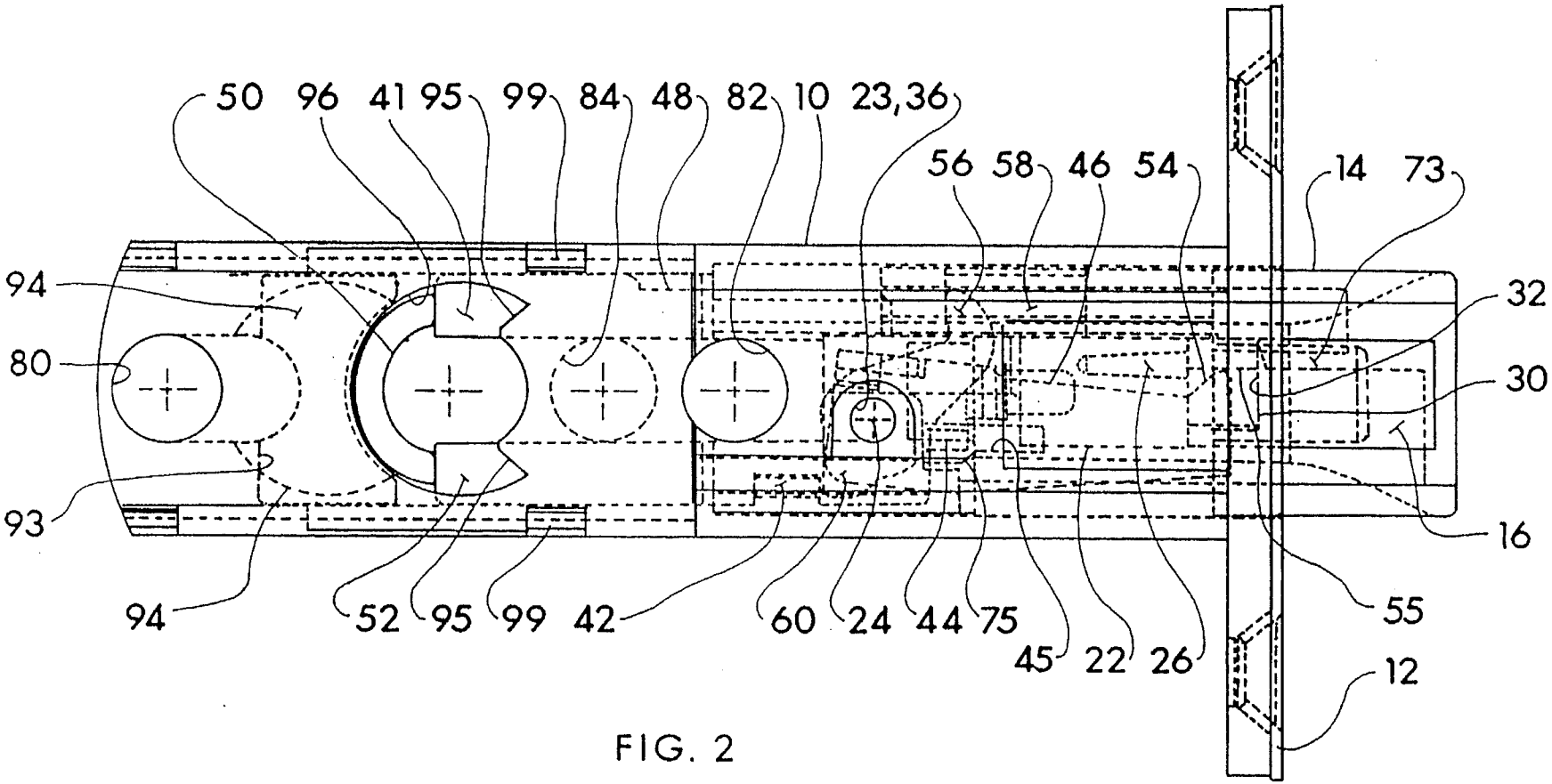
FIG. 2 is a side elevational cross-sectional view of the latch assembly in the extended position.

FIGS. 2–4 illustrate the latch with a 2⅜" backset. The latch casing 10 has three thru holes; One 80 at the rearwardmost end, a second 82 which is spaced from the first hole so that they can receive the stems of the lock assembly and a third hole 84 spaced ⅜" rearwardly from the forwardmost hole 82. The plastic cover 78 shown in FIG. 1 has a hole 86 at the rearward end which overlies hole 80 and a circular cutout 88 which allows hole 82 to be fully exposed when the latch is set for a 2⅜" backset. In the center of the cover is a center hole 90 that receives the half round and a pair of stop surfaces 95 for limiting its rotation in either direction.

Figure 5:
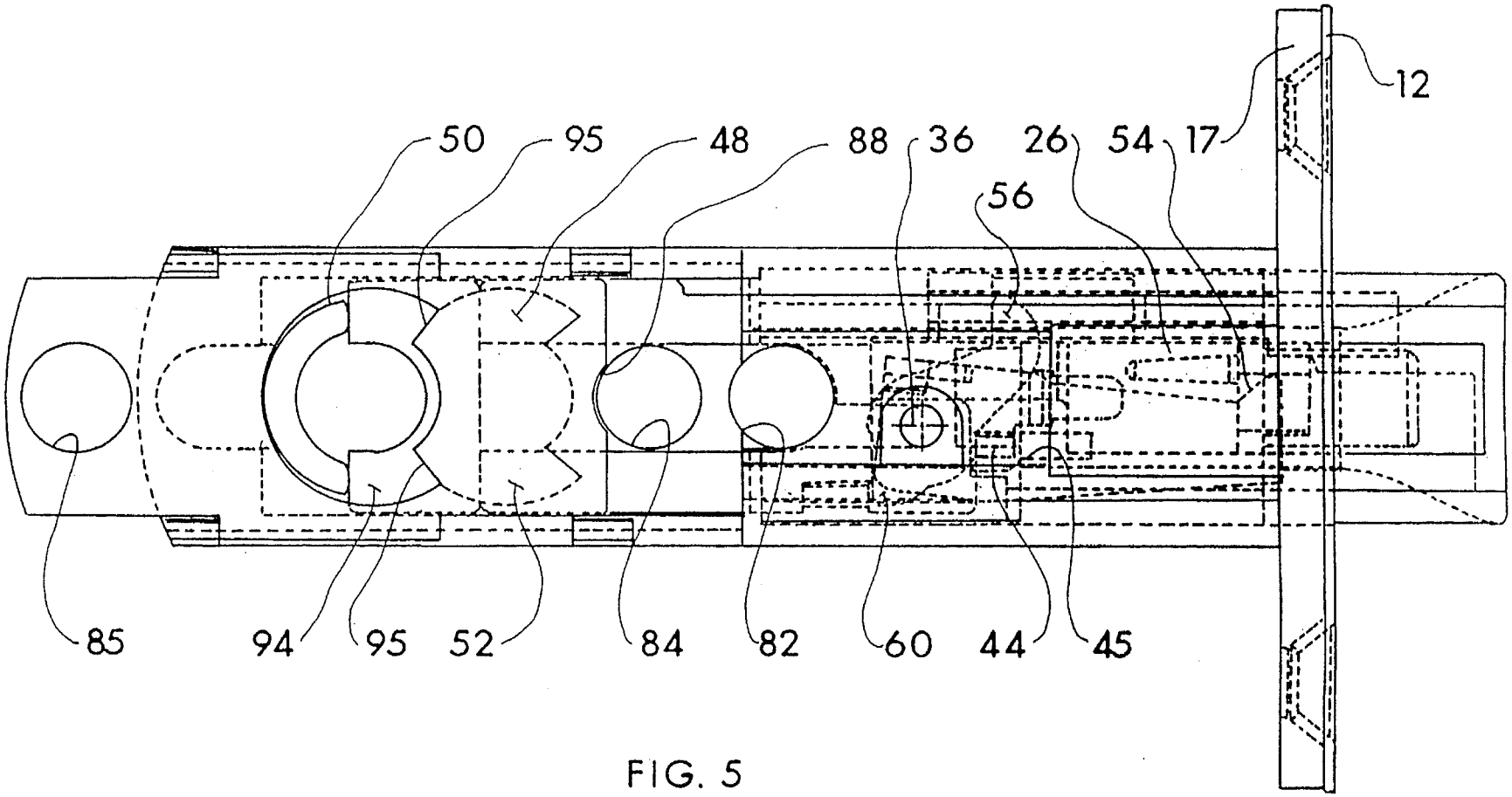
FIG. 5 is a view similar to that of FIG. 2 showing the latch assembly adjusted to 2¾" backset.

To adjust the latch assembly to a 2¾" backset, the cover is shifted rearwardly to its other extreme position (FIG. 5). The middle casing hole 84 has now been exposed (the cover has a circular cutout 88 to completely expose casing hole 84) and since the casing has shifted a distance which equals ⅜", the hole 86 in the cover along with middle casing hole 84 become the stem receiving holes. The spacer bracket converter 92, which is ⅜" wide is moved forwardly from its position shown in FIG. 2 to its position shown in FIG. 5 and the half round now engages this converter, which then moves the retracting member. The backset converter, which is displaceable between the retracting element and the rear wall 93 of a casing pocket, has a pair of rearwardly extending legs 94 which will engage the sides of the half round with a 2¾" backset and a circular surface 96 at the front for engaging the rear surface of the half round with a 2⅜"

backset. The ⅜" shift is accurately controlled. Shifting of the plastic cover to the right to its furthest right (2⅜" backset position) is controlled by the engagement of the upwardly and downwardly projecting roughed portions 98 of the plastic guard with housing stops 99. A push pin 100, which is pushed into a receiving hole in the housing 10 is keyed within an elongated groove 102 on the interior wall of the cover. The elongated groove ends to locate the backset at 2¾". A thru hole 104 is defined at the other end of the elongated groove to permit insertion and removal of the push pin. The plastic cover also has top and bottom runners 106 which are captured within suitable grooves in the housing stops, not shown for clarity.

I claim:

1. An adjustable latch assembly which is to be operated by an operator assembly having a rotatable spindle including a half round actuator and a pair of connection stems which are to be inserted into the adjustable latch assembly, comprising a forward end and a rearward end a cover including a central opening for receiving the half round actuator, said opening having a pair of stop surfaces for limiting clockwise or counterclockwise rotation of the half round actuator and a stem receiving hole in an end portion remote from said stop surfaces at the rearward end of the assembly, a housing for supporting said cover for displacement from one backset location to a second backset location, said housing having a central hole selectively configured so that said cover central opening will be unobstructed at either backset location, a first stem hole aligned with said cover hole when said cover is at one of said backset locations, a second stem hole, which with said first stem hole, will receive the operator stems when said cover is at said one backset location, and a third stem hole rearwardly spaced from said second stem hole a distance corresponding to the difference between the one and the second backset locations, a latch-bolt head at the forward end of the assembly, a retracting assembly operable to displace said latch-bolt head including a displaceable retracting member having rearwardly extending legs for engaging the half round actuator when said cover is at said one backset location, and a backset converter having rearwardly extending legs and an effective length equal to said difference, said housing supporting said backset converter for displacement from a retracted position so that when said cover is at said one backset location, the half round actuator can be inserted into said central opening forwardly of said backset converter engaging said retracting member legs to an advanced position against said retracting member so that when said cover is at a second backset position, the half round actuator can be inserted into said central opening rearwardly of and engaging said backset converter legs.

2. An adjustable latch assembly according to claim 1, wherein an opposing end portion of said cover has a circular groove cut therein so that said second stem hole will be unobstructed when said cover is at said one backset location.

3. An adjustable latch assembly according to claim 2, wherein said cover and said housing further comprise means for limiting the forward and rearward displacement of said cover at said one and said second backset positions.

4. An adjustable latch assembly according to claim 3, wherein said housing further comprises a pocket for supporting said backset converter for movement between said retracted and advanced positions.

* * * * *